United States Patent [19]

Brown

[11] 4,144,611

[45] Mar. 20, 1979

[54] ARTIST'S PAINTBRUSH

[75] Inventor: Anna P. Brown, 12212 Felton Ave., Hawthorne, Calif. 90250

[73] Assignees: Anna P. Brown; Joseph S. Brown, both of Hawthorne; Richard A. R. J. Brown, San Diego, all of Calif.

[21] Appl. No.: 914,488

[22] Filed: Jun. 12, 1978

[51] Int. Cl.[2] ..... A46B 9/02; A46D 1/00

[52] U.S. Cl. ..... 15/192; 15/104 S; 15/111; 15/143 R; 15/159 A; 300/21; D4/38

[58] Field of Search ..... 15/143 R–145, 15/191 R, 192, 193, 235, 159 R, 159 A, 111, 104.5; 300/21; D4/20, 24, 25, 38; D28/56, 57

[56] References Cited

U.S. PATENT DOCUMENTS 3,924,287 12/1975 Brown ..... 15/192

FOREIGN PATENT DOCUMENTS 278938 10/1927 United Kingdom ..... 15/DIG. 5

OTHER PUBLICATIONS

"Brushmaking Materials", by F. Kidd, published Mar., 1957, by British Brush Mfg., Research Assoc., London — pp. 16–21.

*Primary Examiner*—Peter Feldman
*Attorney, Agent, or Firm*—Henry M. Bissell

[57] ABSTRACT

An artist's paintbrush having bristles selected from the guard hair of the tail of a mink. In fabrication, hair is removed from the tail of the mink and the guard hairs are separated from the undercoat, which consists of soft and woolly hairs, preferably by brushing with a wire brush. The guard hairs which remain are selected into shorter and longer guard hairs. The shorter guard hairs are formed into a relatively thick body portion. The longer guard hairs extend beyond the shorter guard hairs to provide a paintbrush capable of painting simultaneously a plurality of extremely thin lines. The mink guard hairs are secured to a ferrule which, in turn, is joined to a wooden handle. The handle has a slim outer portion into which the ferrule is fitted. It has a relatively wider middle portion to provide for easy gripping and a wider rear portion ending in a flat pallet. The pallet may be used for spreading paint. The brush may be secured to the ferrule in any conventional manner.

6 Claims, 2 Drawing Figures

ARTIST'S PAINTBRUSH

BACKGROUND OF THE INVENTION

1. Field of the Invention

This invention relates generally to paintbrushes of animal hair and more particularly relates to a brush which is designed for use by artists.

2. Description of the Prior Art

Artist's paintbrushes have been used for many centuries in the painting of works of art. However, one of the problems which has not been satisfactorily solved in the past is that of providing a paintbrush capable of painting efficiently, for example, the extremely fine hair of a person's head or beard, and similarly, extremely fine lines representing, for example, lace, veins of a flower and the like.

Various fine hairs have been used in the past in artist's brushes. Such soft hair may, for example, be obtained from the body of an animal, such as bear, goat or pony hair. Others are obtained from the tail, for example, of a sable, squirrel or ringcat. The pelt of an animal has two types of hair; a soft, woolly hair forming the undercoat and which serves to keep the animal warm, and a longer, coarser and stiffer guard hair which is believed to act as a protection against rain. A higher proportion of guard hair is found on the tail of most animals than elsewhere.

Since the pelts of may animals are sold for the fur trade, not every pelt is readily available for the manufacture of artist's brushes. However, many of the tails of animals are not used in the fur trade and, hence, may be available for artist's paintbrushes.

The guard hairs from various animals are described as sable. Among these are the black sable, the Kolinsky which is an Asiatic mink, and the Chinese weasel. Squirrels have also been used for artist's paintbrushes as well as have ringcat or ring-tailed cat and skunk. Finally, the fitch may also be mentioned. The ferret is an albino type of the Asiatic fitch.

Research has been carried out to study the properties of different types of hair. Among these are the hair from the tails of the grey squirrel, the wolf, the North American mink, fisher, European marten, as well as North American marten and stone marten, Chinese pahmi, British stoat, British weasel, Japanese mink and camel hair. However, none of these were considered to be suitable for brush making. On the other hand, the hairs of commercial importance are badger, pony, goat, oxear and bear.

It should be noted that when a paintbrush is used to apply paint, the brush marks are not simply indentations made by the bristles. On the contrary, they arise from the unstable flow pattern of paint from brush to wall or other surface to be painted. In addition, a profile is created by groups of bristles and substrate irregularities. Additionally, a very thin and fine brush is not very suitable even for painting fine lines. The reason is that the brush must also contain a body capable of retaining sufficient paint whether oil or watercolor paint.

Reference is also made to the applicant's prior U.S. Pat. No. 3,924,287. This patent discloses and claims an artist's paintbrush having bristles of hairs selected from the tail of a chinchilla. The bristles of chinchilla hair are from a selected region of the chinchilla tail. The paintbrush of the applicant's prior patent, when wet by paint or the like, has an extremely fine tip capable of painting a very fine, single line.

SUMMARY OF THE INVENTION

I have found that the guard hair from the tail portion of a mink will provide an artist's paintbrush capable of drawing a plurality of extremely fine lines, such as the hair of a person's head, and will produce very realistic paintings or portraits. To this end, the hair from the tail of a mink or a portion thereof is removed, for example, by cutting it off. Subsequently, the soft woolly undercoat hair is removed. This may, for example, be effected by using a wire brush to brush out the undercoat hair. What is now left is the guard hair, some of which is longer and others shorter.

A relatively large amount of the shorter guard hairs is collected. The longer guard hairs are disposed on the outside of the resulting body of a paintbrush. The body portion is designed to retain paint, such as oil or water paint or other types of paint. The long guard hairs will spread out even when wet by paint to form a plurality of individual tips. Each of the very fine tips provided by individual long guard hairs is capable of painting a fine line. Hence, since a plurality of such fine tips are provided, a plurality of very fine lines can simultaneously be painted. This will result in extremely fine, realistic-looking lines with oil, watercolor, acrylic and the like. Since many hairs can be painted simultaneously, the artist's work will consume less time and be more efficiently effected.

The brush portion is now mounted in a generally cylindrical ferrule in any known manner. For example, the tufts of hair collected as previously explained may be glued by liquid aluminum solder or otherwise, as by ordinary adhesive, in a suitable holder so that the brush portion is solidly fixed and retained in the desired form. The secured tufts of long and short guard hairs may now be inserted into a ferrule and the end of the ferrule may be crimped.

I prefer to use a wooden handle having a tapered front portion to which the ferrule is secured, for example, by one or more brads. The middle portion of the handle has a slightly enlarged diameter to facilitate gripping it by the fingers of the artist. The rear portion of the handle may be tapered to a smaller diameter and may have an enlarged rear portion with a tapered flat surface to form a pallet which is substantially thicker at the end. I prefer to use a handle made of Calcutta wood which is a form of bamboo, but which is solid rather than hollow. Such wood has a desirable flexibility and resilience so that a paintbrush having such a handle may be dropped without likelihood of damage.

The novel features which are considered characteristic of this invention are set forth with particularly in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENT

Figure 1:
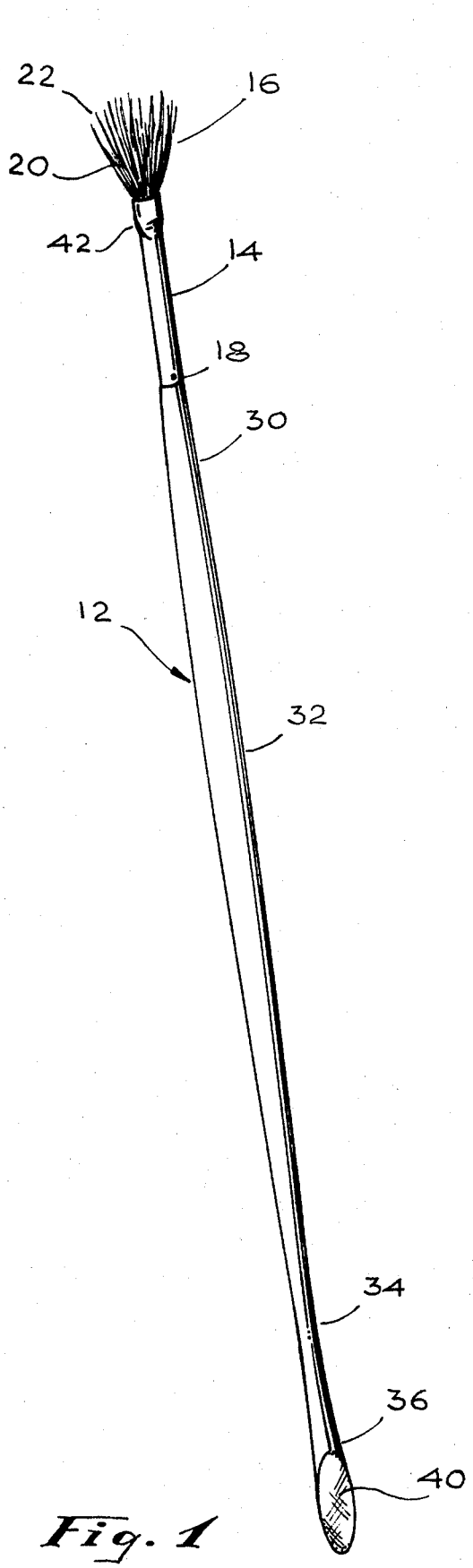
FIG. 1 is an elevational view of an artist's paintbrush in accordance with the present invention and showing the brush portion thereof in its dry form.
Figure 2:
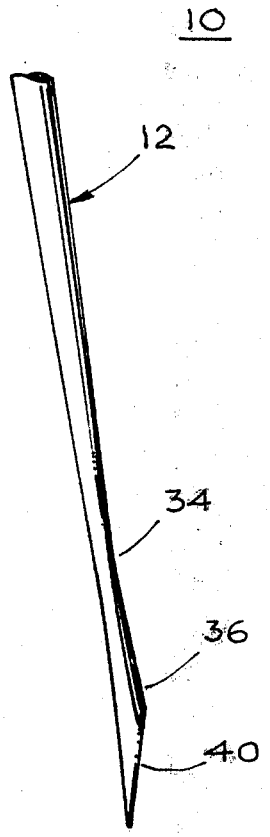
FIg. 2 is a view normal to that of FIG. 1 of a portion of the handle showing the pallet thereof in side elevation.

Referring now to FIGS. 1 and 2, a paintbrush 10 embodying the present invention is illustrated and has a handle 12 disposed in a ferrule 14 from which extends a brush portion 16. The ferrule 14 is of substantially cylindrical form. The handle 12 is inserted into the ferrule 14 and may, for example, be secured thereto by one or more brads 18. The ferrule 14 may be formed of a small sheet of thin metal rolled into cylindrical form, or else it may consist of a thin metallic cylinder.

The brush portion 16 consists of a large amount of short guard hairs 20, and a small amount of long guard hairs 22 disposed on the outside of the short guard hairs 20.

FIG. 1 illustrates the paintbrush 10 with the guard hairs 20 and 22 flared out. Even when the brush is wet, for example, by water or oil paints, the long guard hairs 20 will still be separated from each other thereby to form a plurality of fine tips. Hence, essentially each of the long guard hairs 22 is capable of drawing an individual line. As a result, with one brush stroke, a plurality of fine lines can be painted or drawn at the same time.

Referring now to the handle 12, this consists preferably of wood, such as Calcutta wood as referred to hereinabove. The handle 12 has a relatively thin end 30 which extends into the ferrule 14. It has a central portion 32 of somewhat larger diameter to facilitate holding the paintbrush by the fingers of the artist. It is then tapered down again as shown at 34, while the rear portion 36 is relatively wide. Preferably it is formed with a pallet 40 having a flat surface forming an acute angle with a plane extending through the body of the handle as shown in FIG. 2.

The pallet 40 may, for example, be used by the artist for spreading different colors. For example, two or three shades of paint may be put on the pallet 40. The pallet may then be slid transversely at an angle over a tree trunk to be painted thereby to spread the paint.

As referred to hereinabove, the guard hair of the brush portion 16 is taken from the tail of a mink. The air is removed, for example, by cutting it, and the undercoat is brushed out, for example, by a wire brush. What remains is the guard hair, some of which is longer and some of which is shorter. A relatively large amount of the shorter guard hair is collected and formed into a brush-like appearance which is then surrounded by a selected few long guard hairs as shown at 22. By way of example, there may be on the order of thirty long guard hair.

The thus obtained brush may be set or secured in a desired, conventional manner. For example, the hair may be set in a suitable holder or cup where it is glued or secured by a suitable glue, such for example, as aluminum solder. The thus secured body of hair or brush portion is inserted into the ferrule 14, and the end of the ferrule is crimped as shown at 42. However, it will be understood that other methods may be utilized for securing the brush portion to the ferrule and in turn, to the handle.

I have found that an artist's paintbrush in accordance with my invention may be used for painting simultaneously many hairs which are very realistic and very fine. They are particularly suitable for painting portraits and the like. Also, the pallet 40 on the handle has been found to be very useful for spreading colors over a painting by putting several shades of paint on the pallet and sliding it transversely over the surface to be painted.

What is claimed is:

1. An artist's paintbrush comprising:

a handle;

a ferrule having one end secured to said handle; and a brush portion mounted in the other end of said ferrule and extending outwardly therefrom, said brush portion comprising guard hairs from the tail of a mink which have been separated from the undercoat hair, said brush portion consisting of a larger number of short guard haris and a smaller number of longer guard hairs being capable of painting simultaneously a plurality of fine lines.

2. A paintbrush as defined in claim 1 whereby said brush portion includes on the order of thirty long guard hairs.

3. A paintbrush as defined in claim 1 wherein the long guard hairs of said brush portion substantially surround the short guard hairs thereof.

4. A paintbrush as defined in claim 1 wherein said handle has a relatively thin end to which said ferrule is secured, a middle portion of enlarged diameter and an enlarged end portion ending in a substantially flat pallet.

5. A paintbrush as defined in claim 4 wherein said pallet forms an acute angle with a plane extending longitudinally through said handle.

6. In the process of preparing a brush portion for an artist's paintbrush, the steps of:

removing hair from the tail of a mink;

brushing the hair of remove the undercoat;

subsequently selecting both short and long guard hairs; and combining the thus selected guard hairs to form a brush portion having a relatively thin surrounding portion formed by the long guard hairs for painting a plurality of fine lines.

* * * * *